US006481228B1

(12) United States Patent
Chiang et al.

(10) Patent No.: US 6,481,228 B1
(45) Date of Patent: Nov. 19, 2002

(54) AIR CONDITIONING MODULE FOR ROOM PARTITION UNIT

(75) Inventors: Hsu-Cheng Chiang; Hsiao-Chi Hsu; Chih-Chun Su; Chien-Chang Hung, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/934,687

(22) Filed: Aug. 23, 2001

(51) Int. Cl.[7] ..... F25B 41/04; F25D 23/12

(52) U.S. Cl. ..... 62/223; 62/263

(58) Field of Search ..... 62/263, 223, 262, 62/160, 229, 150, 175, 185, 198, 179, 224, 225

(56) References Cited

U.S. PATENT DOCUMENTS 3,220,711 A * 11/1965 Leppard et al. ..... 261/133
3,722,580 A * 3/1973 Braver ..... 165/50
4,353,411 A * 10/1982 Harter et al. ..... 165/48 R
4,852,362 A * 8/1989 Conry ..... 62/175
4,958,500 A * 9/1990 Kuroda et al. ..... 62/89
5,142,877 A * 9/1992 Shimizu ..... 62/129
5,467,604 A * 11/1995 Sekigami et al. ..... 62/117
6,324,859 B1 * 12/2001 Tesche et al. ..... 62/262

* cited by examiner

*Primary Examiner*—Denise L. Esquivel
*Assistant Examiner*—Marc Norman
(74) *Attorney, Agent, or Firm*—Birch, Stewart, Kolasch & Birch, LLP

(57) ABSTRACT

An air conditioning module applicable to a partition panel is disclosed herein. The air conditioning module includes a heat exchanger and a blower mounted inside the panel. The partition panel is suitable for assembling a modular personal working compartment in an office. A heat transfer medium is provided to the air conditioning module for generating cooled or heated air for the personal working space. The operation of the air conditioning module can accommodate individual needs, as well as save energy.

18 Claims, 18 Drawing Sheets

AIR CONDITIONING MODULE FOR ROOM PARTITION UNIT

BACKGROUND OF THE INVENTION

1. Field of Invention

The present invention generally relates to an air conditioning module built in a room partition unit, and more particularly relates to an air conditioning module built in a modular partition panel for a personal working compartment, in which a heat exchanger, conduits for a heat transfer medium and a blower are incorporated into the partition panel.

2. Related Art

A conventional air conditioning system mainly includes several air vents located in the ceiling at different positions for spreading conditioned air to certain portions of a room or rooms. This kind of system has the following disadvantages:

a) Unnecessary power consumption is caused by the system because a temperature is preset to manage the operation purpose without considering the number of people in the room;

b) The efficiency of the refrigeration system is relative low since the supply air-flow rate is smaller and the temperature difference is larger at the exit, so that the temperature of the discharged and returned water is lower, or the evaporation temperature of the refrigerant is lower;

c) The load and power consumption of the system will increase because the radiation heat from the lighting devices,the ceiling and the walls is brought into the room.

SUMMARY OF THE INVENTION

It is therefore an object of the invention to provide an air conditioning module built in a room partition panel. The panel can be freely assembled, and meets the requirements of air-conditioning in a personal working compartment.

Another object of the present invention is to provide an air conditioning module built in a room partition panel, which can base on the actual needs of an individual in a specific working compartment, and prevent from wasting electrical energy.

To achieve the aforesaid objects, an air conditioning module built in a room partition panel according to the present invention includes at least a heatexchanger and a slim blower incorporated into a vertically standing partition panel. The air conditioning module can be applied as an individual element, or combined with a plurality same type modules, Then the modules can match with the ducts of heat transfer mediums to form office partitions. Furthermore, it can assemble with office desks and chairs to become office furniture.

The partition panel with air conditioning module is thus applicable to construct a personal working compartment in a room. By using the heattransfer medium from a supply system through ducts to the air conditioning module, the partition panel can provide cool or warm air to the person who uses the working compartment.

An embodiment of the partition panel with air conditioning module according to the invention further includes the air filters, the activated charcoal and the ozone cleaning apparatus inside the partition panel for removing particles dust, and some harmful airborne materials, in order to achieve the air cleaning effect.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will become more fully understood from the detailed description and drawings provided below. However these drawings are for the purposes of illustration only, and thus are not limitative of the present invention, and wherein.

DETAILED DESCRIPTION OF THE INVENTION

Figure 2:
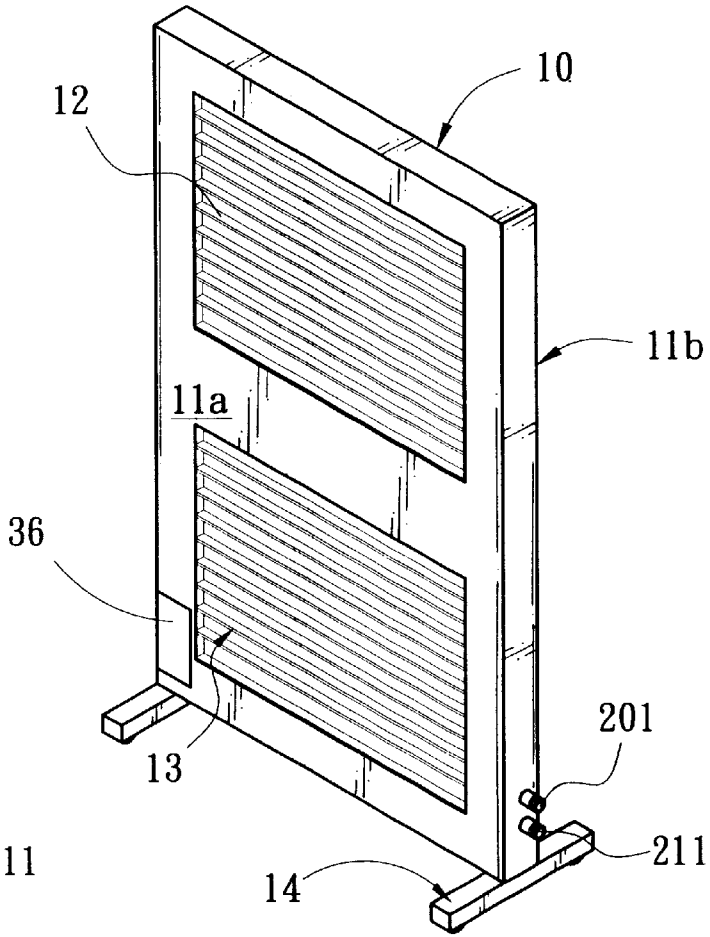
FIG. 2 is a configuration of a partition panel with air conditioning module according to the invention.
Figure 1:
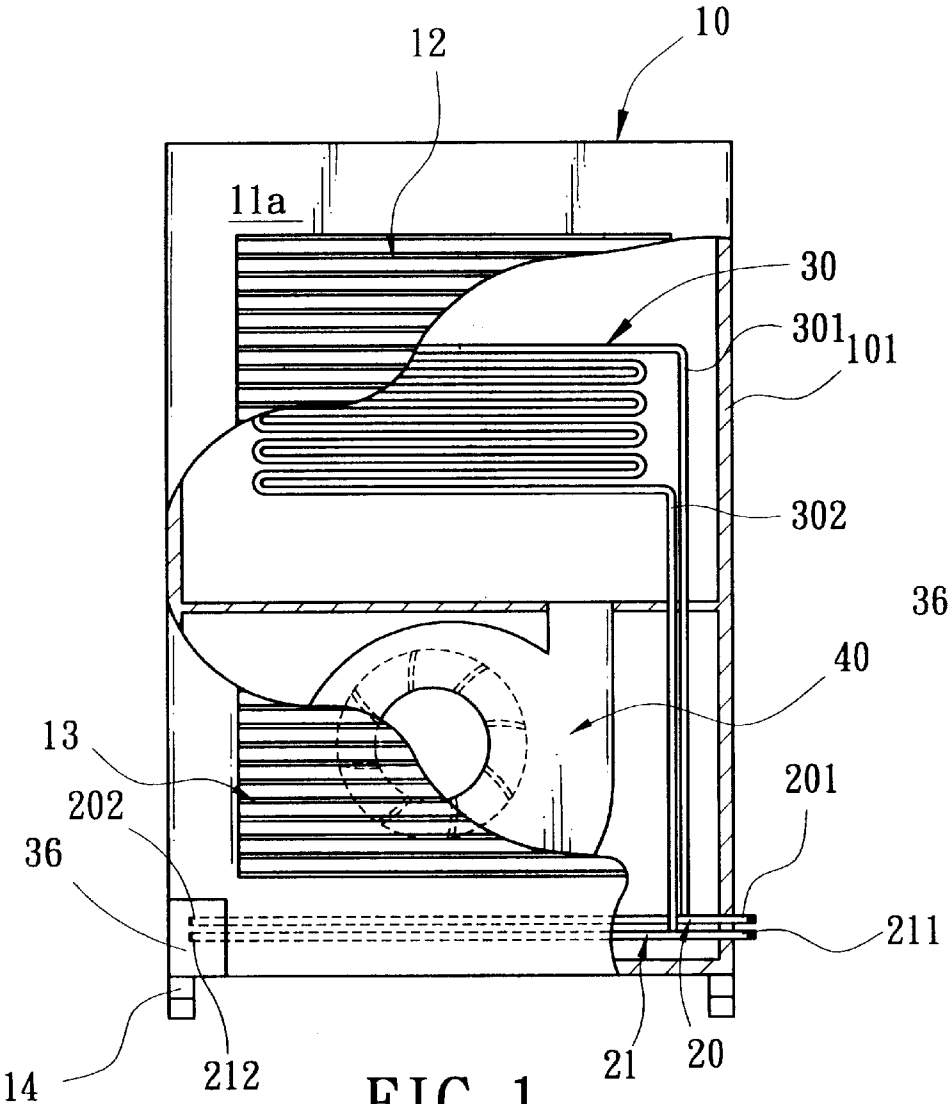
FIG. 1 is an embodiment of an air conditioning module built in a partition panel according to the invention.
Figure 15:
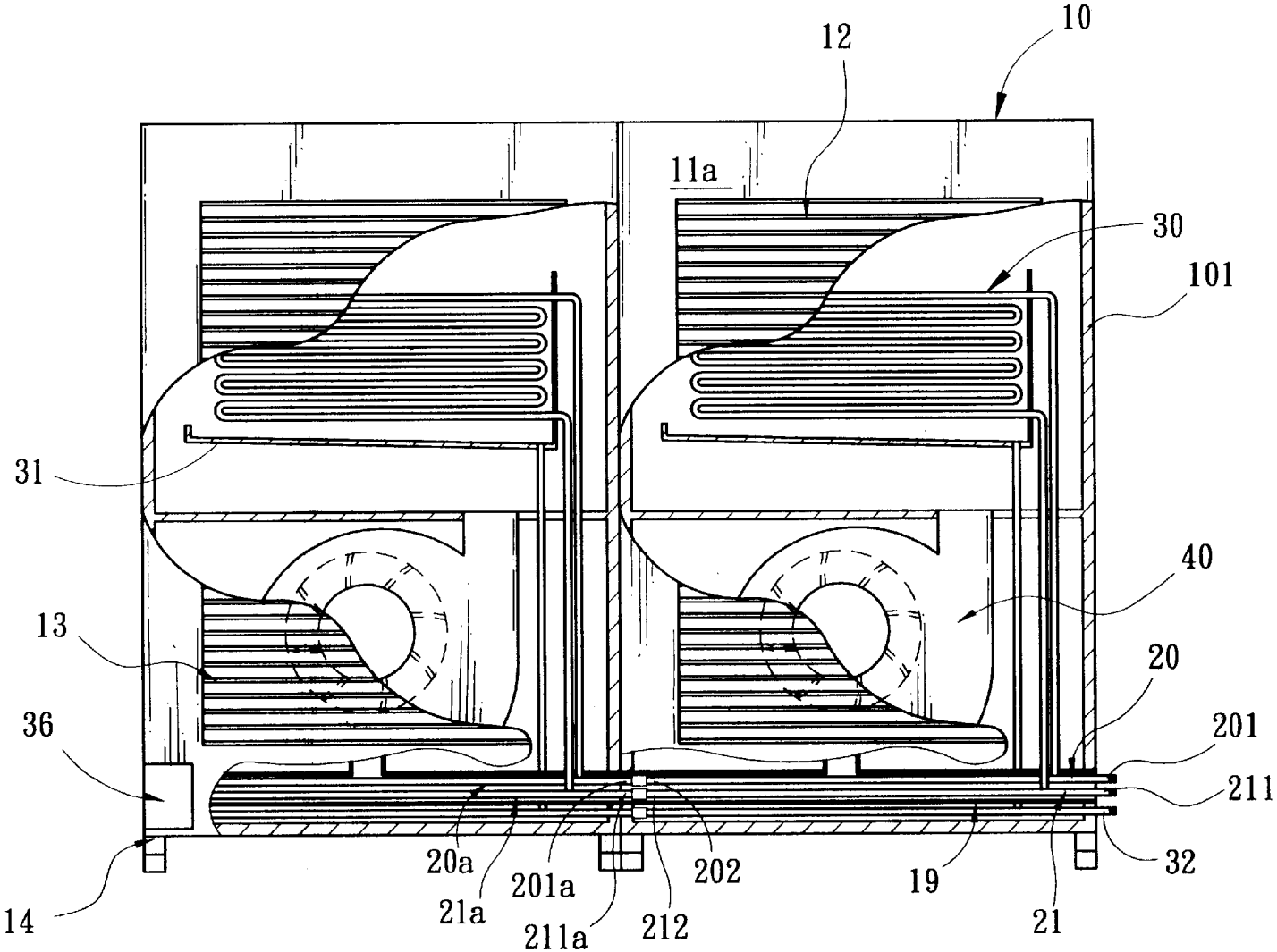
FIG. 15 is a applied example of two air-conditioning modules of the same type in parallel.
Figure 16A:
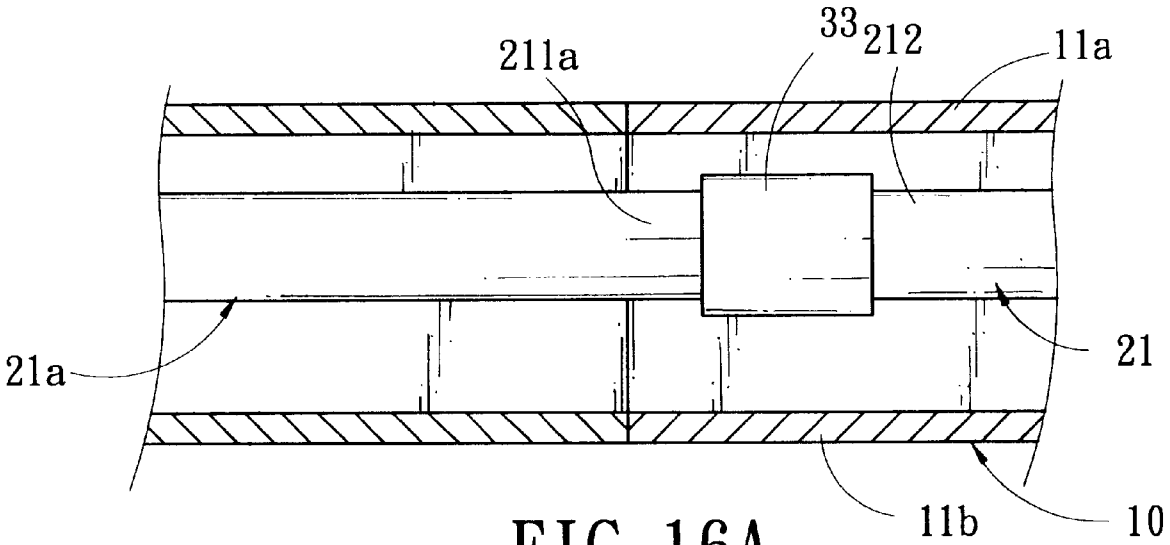
FIGS. 16A and 16B are partial views of an air-conditioning module of the invention, showing the configurations for connecting and sealing ducts of air or heattransfer mediums.

As shown in FIGS. 1 and 2, an air conditioning module built in a room partition panel according to the invention includes a partition panel 10 composed of a side frame 101 and two opposite vertical panels 11*a*, 11*b*. The side frame 101 and the vertical panels 11*a*, 11*b* form the partition panel 10 with an interior cavity. The partition panel 10 further includes at least an air outlet 12, a return air inlet 13 and an air passage linked the air outlet with the air inlet inside the partition panel 10. A supplying duct 20 is used for delivering the heattransfer medium, such as refrigerant, chill water or hot water, into the partition panel 10. The ends of the supplying duct 20 are defined as an inlet port 201 for connecting to a supplier of the heat transfer medium, and a connecting port 202 for linking to an inlet port 201*a* of a supplying duct 20*a* of a same type partition panel (as shown in FIG. 15). Thus, a plurality of the same type partition panels 10 can share the heat transfer medium from the same supplier. A returning duct 21 is used for delivering the heat transfer medium back to the supplier. The ends of the returning duct 21 are defined as an outlet port 211 for connecting to a suction end of the supplier, and a connecting port 212 for linking to an outlet port 211*a* of a same type returning duct 21*a* (as shown in FIGS. 15 and 16A). Thus, a plurality of the same type partition panels 10 can return the heat transfer medium to the same supplier. A heat exchanger 30 installed inside the partition panel 10 includes an entrance 301 connecting to the supplying duct 20, and an outlet 302 connecting to the returning duct 21. Therefore, the heat transfer medium coming from the supplier will pass through the supplying duct 20, the heat exchanger 30, the returning duct 21, and finally return to the supplier. A blower 40 suck air from a return air inlet 13, and delivers them through the surface of the heat exchanger 30, then discharges cool or warm air into the room via an air outlet 12.

Figure 3:
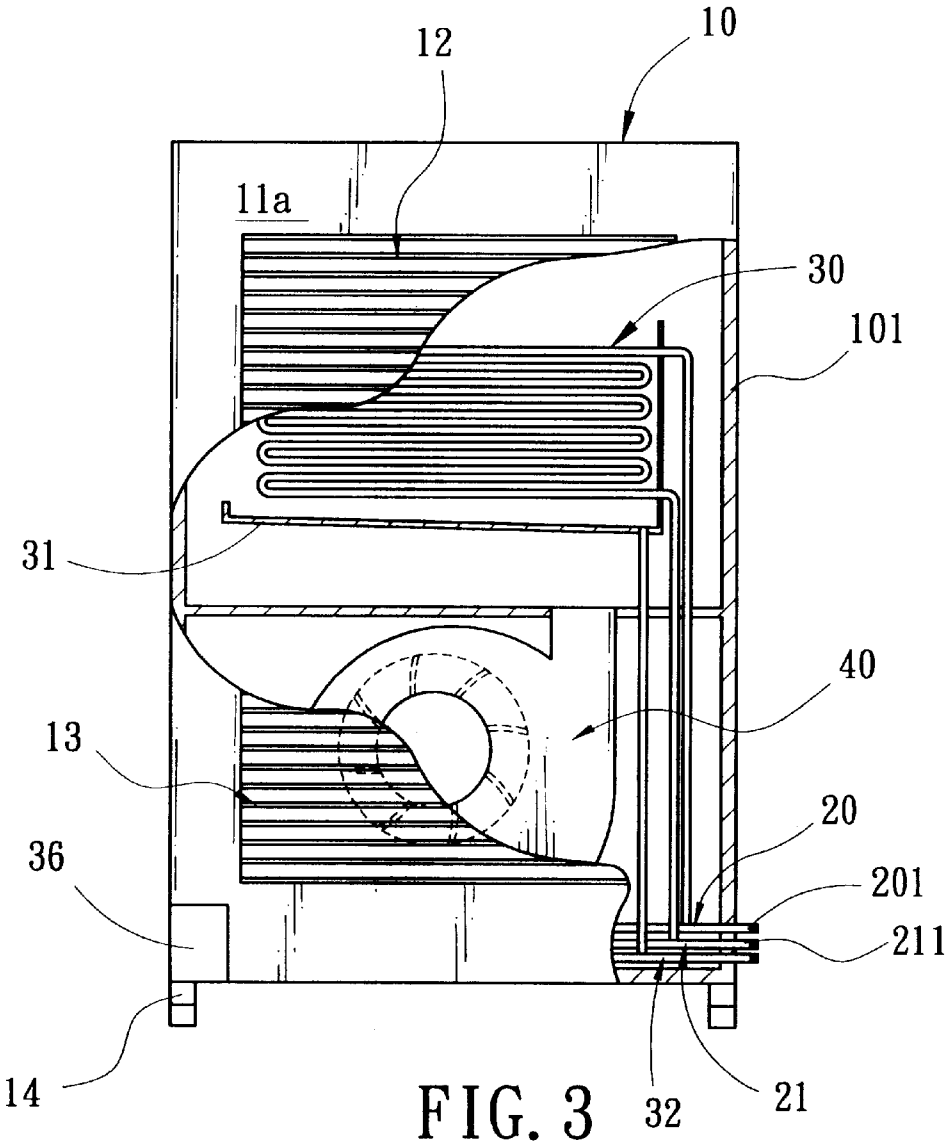
FIG. 3 is another embodiment of an air conditioning module built in a partition panel according to the invention.

FIG. 3 is another embodiment of an air conditioning module built in a partition panel according to the invention. This embodiment is based on the first embodiment as shown in FIG. 1, but including a water reservoir 31 and a drain 32 located under the heat exchanger 30. When the air conditioning module operates, water will condense on the surface of the heat exchanger 30. The condensed water will then be collected in the water reservoir 31 and discharged from the drain 32.

The partition panel 10 is composed of a side frame 101 and two opposite vertical panels 11*a* and 11*b*. Stands 14 are formed in the bottom of the partition panel 10 so as to stand it on the ground. Of course, if necessary, the partition panel 10 can be fixed or lean against a wall.

Figure 7:
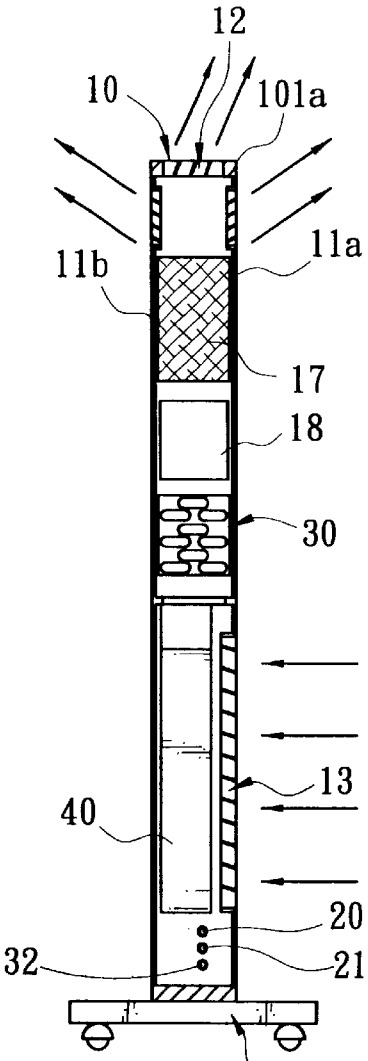
FIGS. 4 through 8 are sectional views of the invention showing embodiments of interior structure thereof.
Figure 6:
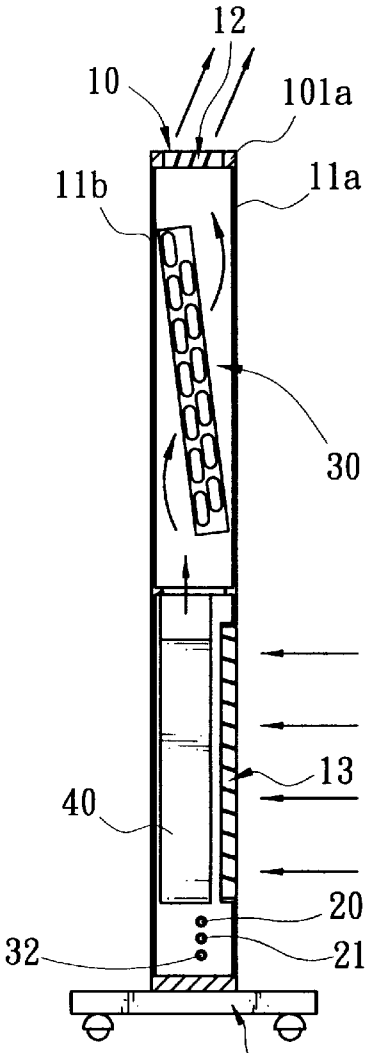
Figure 5:
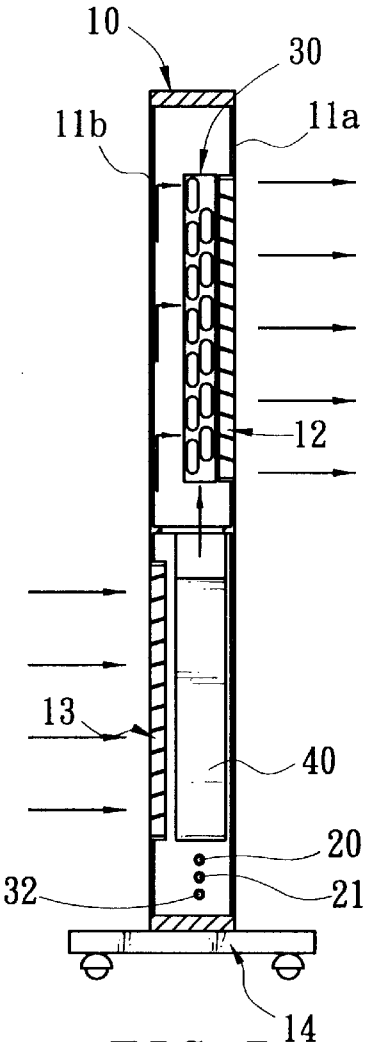
Figure 4:
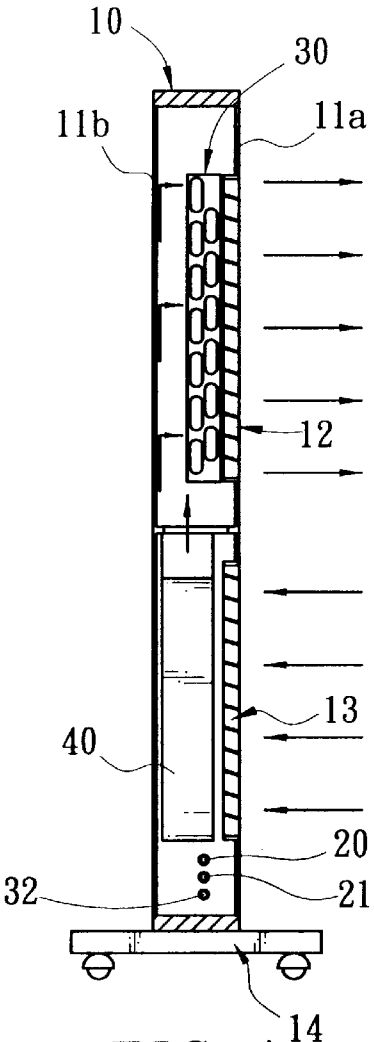

The return air inlet 13 and the air outlet 12 are basically openings connected between the interior and the exterior of the partition panel 10. They can be located on one of the following:

a) They can both be placed on a single panel, such as on the vertical panel 11*a*, as shown in FIG. 4, or on the two vertical panels 11*a* and 11*b* respectively, as shown in FIG. 5.

b) The return air inlet 13 can be located on one of the vertical panels 11*a* or 11*b*, while the air outlet 12 is located on top of the partition panel 10, i.e., on the top rim of the frame 101*a* (as shown in FIG. 6), for discharging air in an upward direction.

c) The return air inlet 13 can be located on one of the vertical panels 11*a* or 11*b*. The air outlet 12 can then be located on the upper portion of the partition panel 10, i.e., on the top rim of frame 101*a* and on the upper portions of the two vertical panels 11*a* and 11*b* (as shown in FIG. 7), in order to discharge air in a eadiaut direction.

Figure 8:
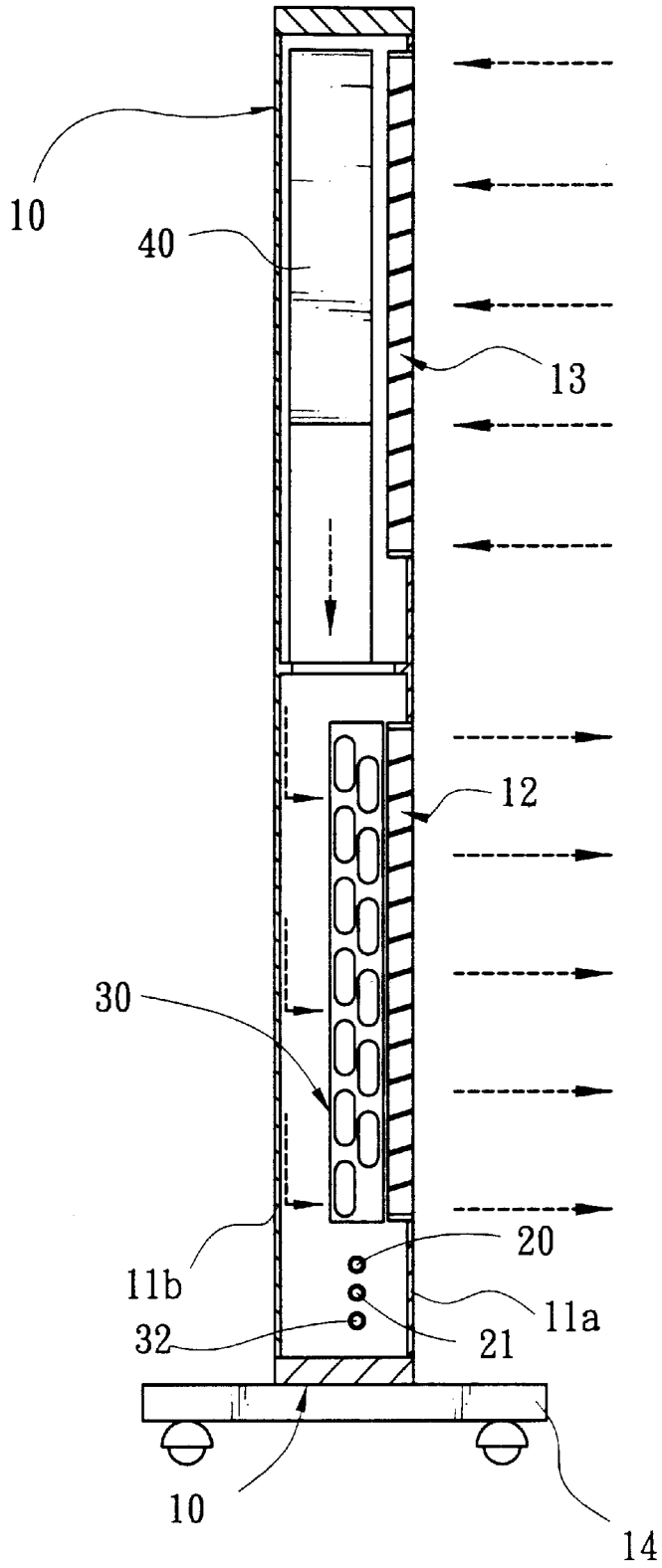

For providing cool air, the air outlet 12 is preferably located in a higher position, while the return air inlet 13 is located in a lower position. Because of the principle of natural convection currents, the discharged cool air willful and spread in the room. When providing warm air, however, the air outlet 12 is preferably located in a lower position, while the return air inlet 13 is located in a higher position. Thus, the discharged warm air can rise naturally and spread in the room, as shown in FIG. 8.

Figure 9:
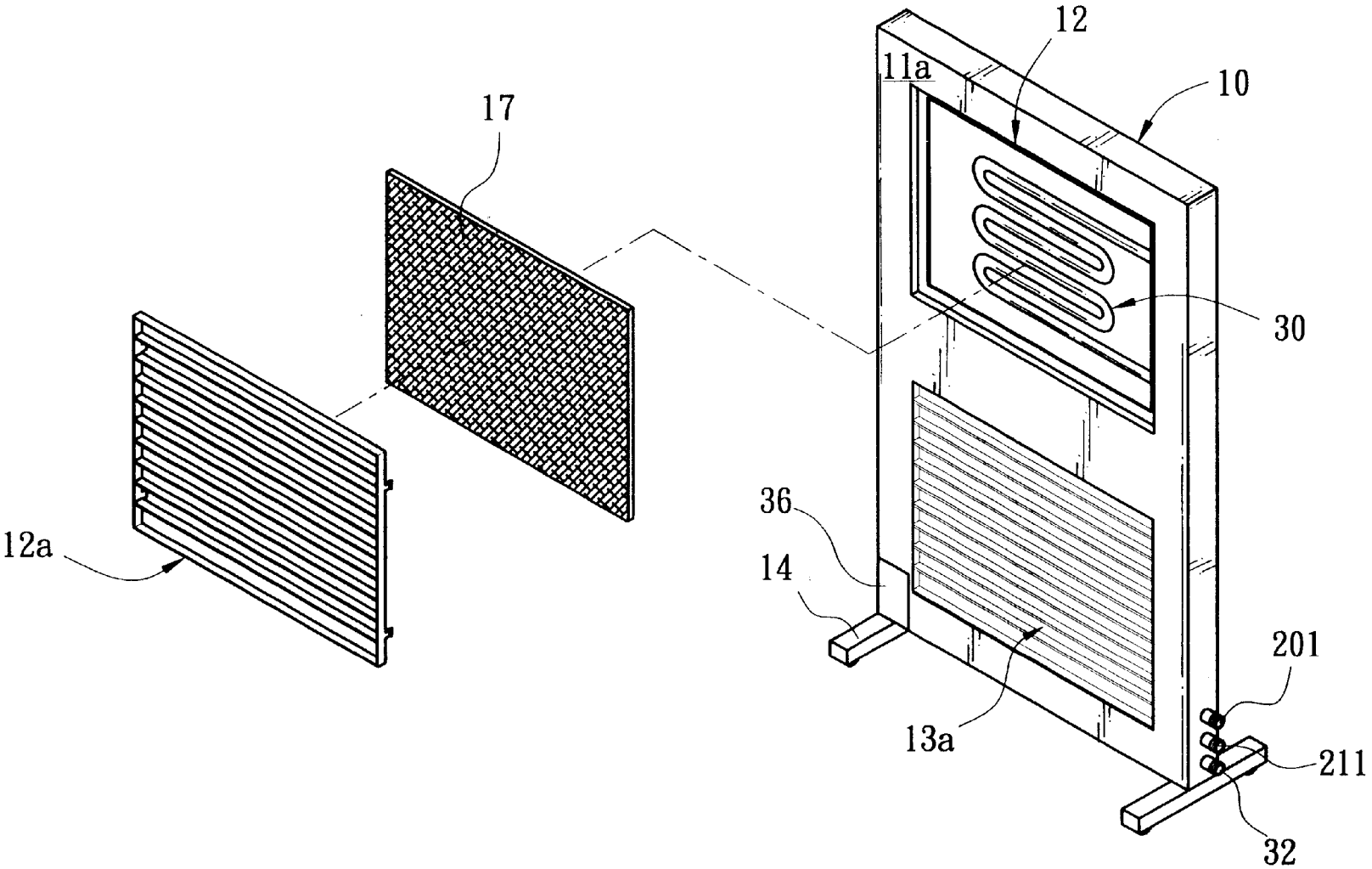
FIG. 9 is a further embodiment of an air conditioning module built in a partition panel according to the invention, showing a detachable return-air panel and filter.

The air outlet 12 and the return air inlet 13 can be made as detachable panels mounted on the vertical panels 11*a* and 11*b*. For example, as shown in FIG. 9, an air outlet panel 12*a* and an air inlet panel 13*a* are mounted on one of the vertical panels 11*a* or 11*b* by means of screws or fasteners. Therefore, they can be easily removed for cleaning.

Figure 10B:
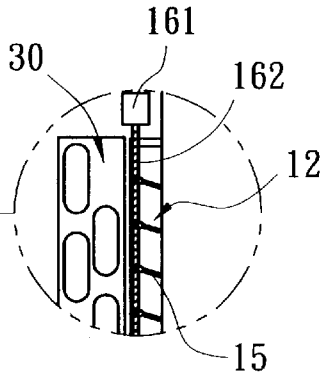
FIGS. 10A and 10B are sectional views of an air-conditioning module built in a partition panel according to the invention, showing a structure of the guide vans at the air outlet.
Figure 10A:
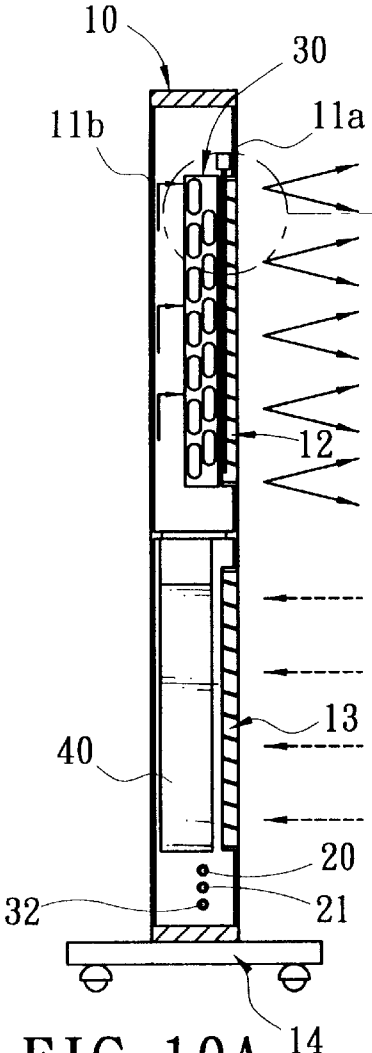

The air outlet 12 and the return air inlet 13 can be formed with the guide vans 15. An automatic swinging mechanism, such as that driven by a small size motor 161 and worm gear 162, can be used to operate the guide vans 15, as shown in FIGS. 10A and 10B. Or, manually operated guide vans can also be used. Therefore, the discharged air can be guided in desired directions to avoid directly blowing to a person and causing discomfort.

Figure 12:
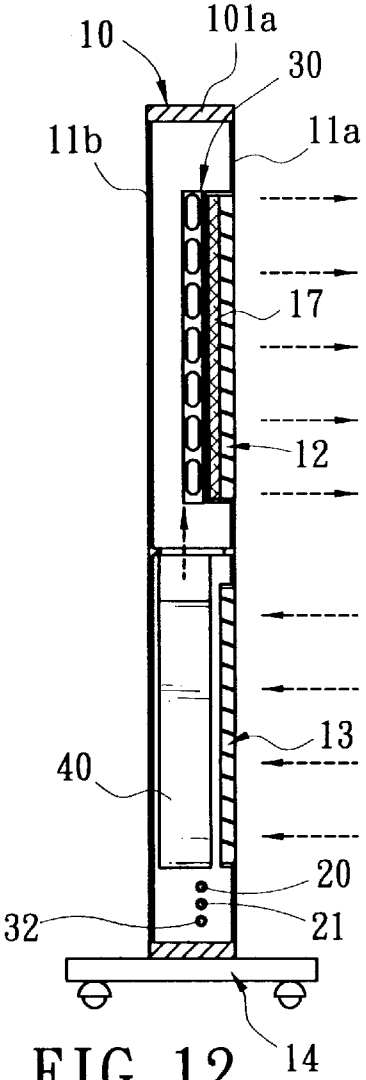
FIGS. 11 and 12 are sectional views, each showing an air-conditioning module built in a partition panel and incorporating a filter.
Figure 11:
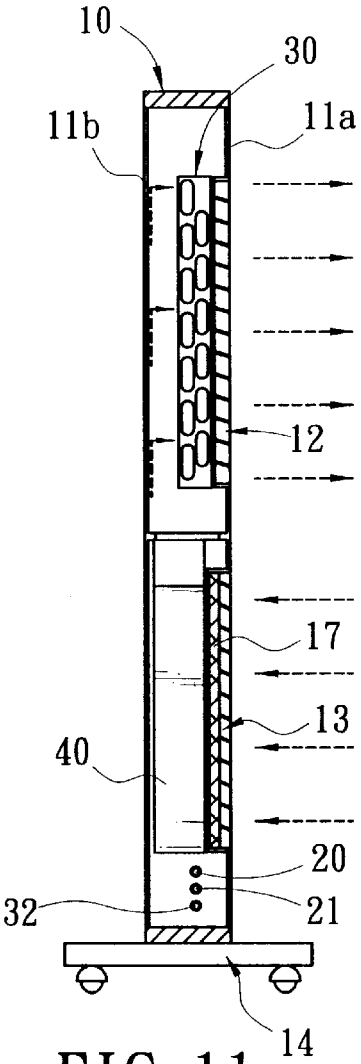

The blower 40 is substantially a fan, such as a centrifugal fan or an axial fan, mounted inside the partition panel 10. The blower 40 sucks air from the return air inlet 13, and delivers them through the heat exchanger 30, then discharges the conditioned air into the room via the air outlet 12. In the air passage inside the partition panel 10, there is an air cleaning device, such as the air filters 17, the activated charcoal or the ozone cleaning apparatus 18 (as shown in FIG. 7), for removing particles and some harmful airborne materials, in order to achieve the air cleaning effect. The filter 17 is preferably mounted on the return air inlet 13, as shown in FIG. 11, so as to keep the interior of the partition panel 10 clean. Or, the filter 17 can also be mounted on the air outlet 12, as shown in FIG. 12. When a detachable air outlet panel 12*a* or air inlet panel 13*a* is applied, the filter 17 can be mounted on or near the panel 12*a* or 13*a* so that it can be easily replaced or cleaned after the panel is removed.

Figures 13A, 13B:
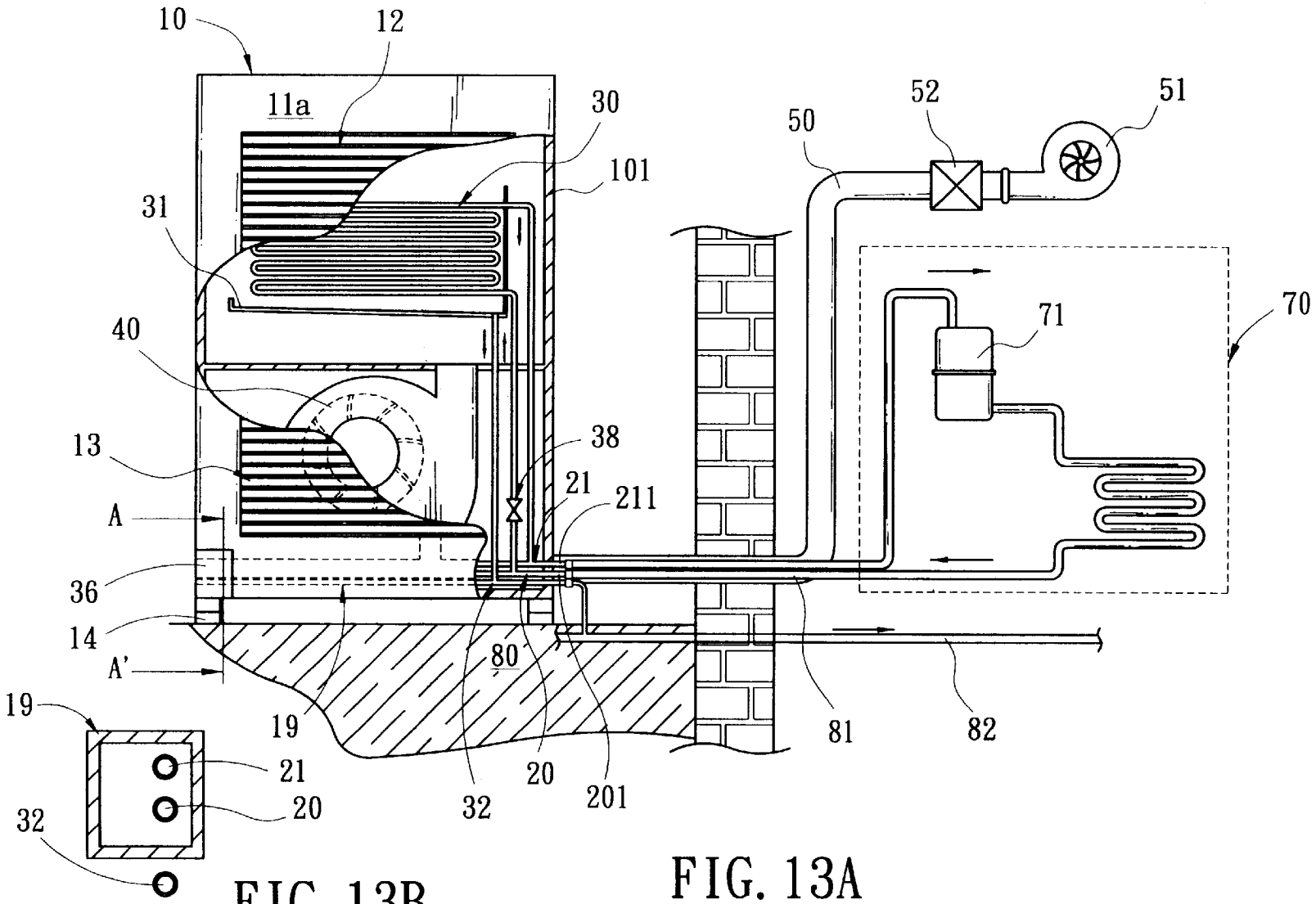
FIGS. 13A and 13B are sectional views of an air-conditioning module built in a partition panel connecting with an outside air supply apparatus.

FIGS. 13A and 13B illustrate another embodiment of the invention in which an outside air supplying duct 19 is incorporated with the partition panel 10. The room or building is equipped with an outside air import duct 50 and other required devices, such as a blower 51 and an air filter 52, so as to provide fresh air to the room. The fresh air is delivered through the outside air import duct 50 to the outside air supplying duct 19, then it passes through the heat exchanger 30, and is discharged into the room from the air outlet 12. The outside air supplying duct 19 is located at the bottom of the partition panel 10. The cross-sectional dimension of the outside air supplying duct 19 is as large as possible when fitting with the partition panel 10, so as to obtain the largest quantity of fresh outdoor air. As shown in FIG. 13B, the supplying duct 20 and the returning duct 21 for the heat exchanger 30 can also be included in the outside air supplying 19, so as to save the space inside the partition panel 10.

Figure 14:
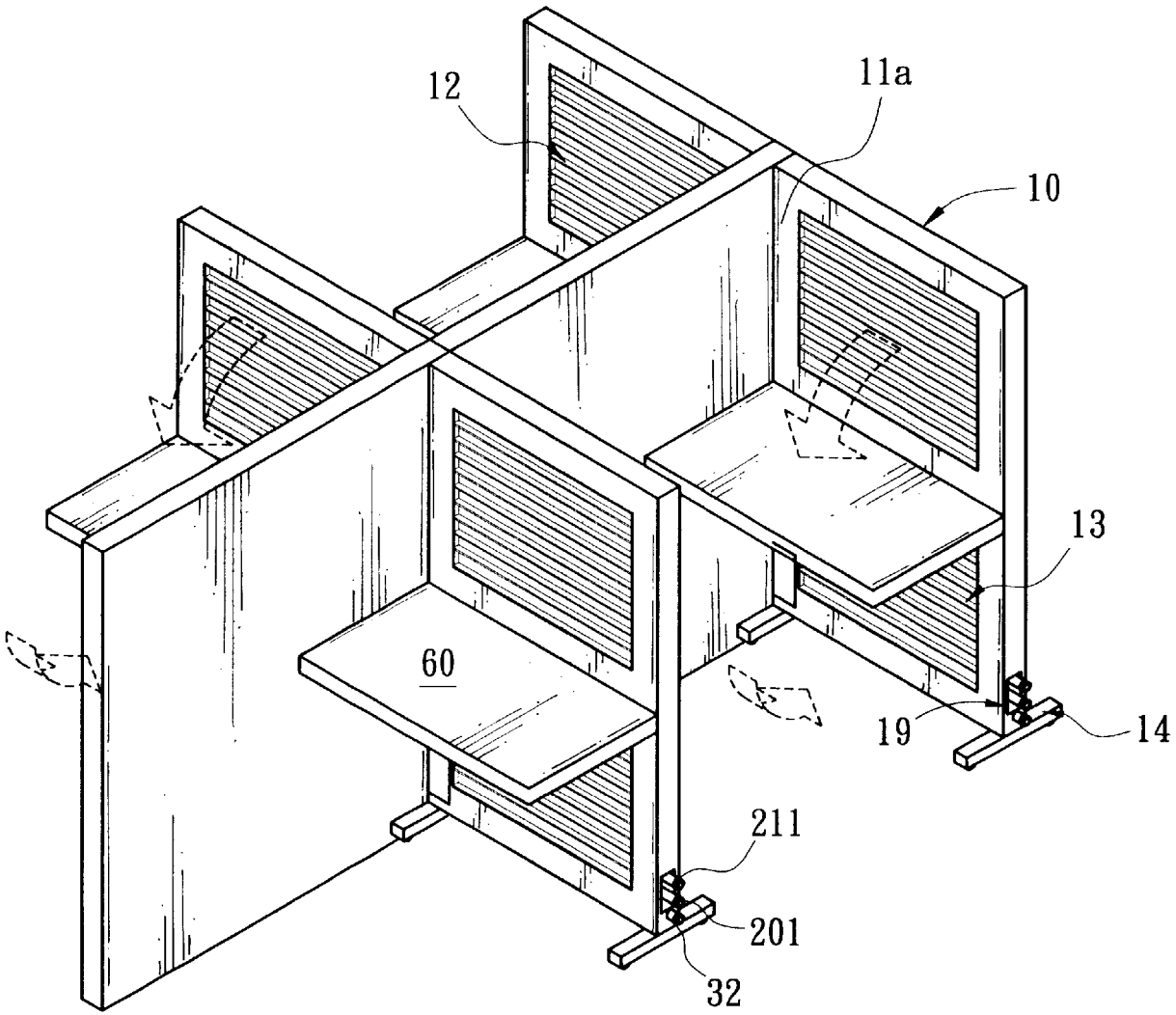
FIG. 14 is a applied example of the air-conditioning modules of the invention, showing the partitions of an office.

The air conditioning module of the invention mainly satisfies the requirements of personal air conditioning, and is suitable for the application of office partitions and for separating personal working spaces. According to the actual space requirements, a plurality of partition panels with air conditioning modules can be assembled to partition several personal working spaces, as shown in FIG. 14. In addition, considering the location of the air outlet 12, the partition panel 10 can link with a desk board 60 on either of the vertical panels 11*a* or 11*b* to form a desk. Therefore, a person sitting in front of the desk can enjoy the cool or warm air coming from the air outlet 12 of the air condition module built in a room partition unit.

In the modular design, the ducts of the partition panel can be suitably located so as to make two adjacent partition panels use common ducts for the air or heat transfer medium. As shown in FIG. 15, when two partition panels 10 are adjacently mounted, the two supplying ducts 20, returning ducts 21, condensed water drains 32 and outside air supplying ducts 19 link together respectively, so that the two partition panels 10 share the same heat transfer medium, the same fresh outside air, and the same condensed water drain.

Figure 16B:
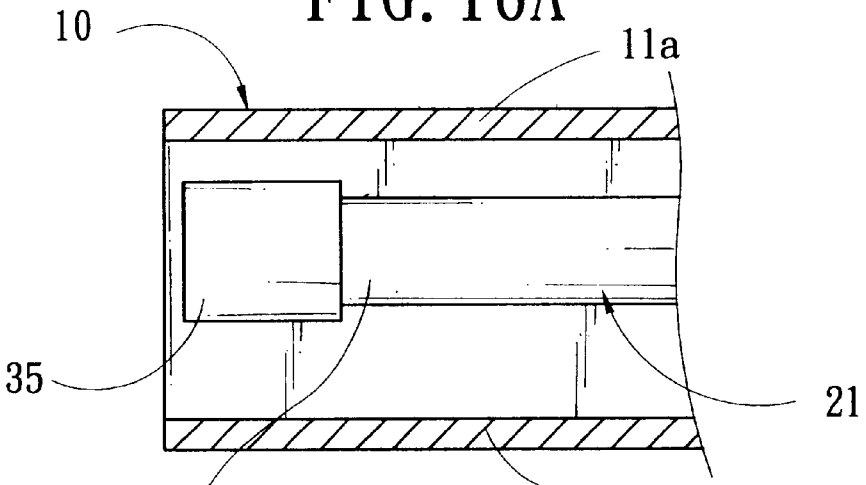
Figure 17:
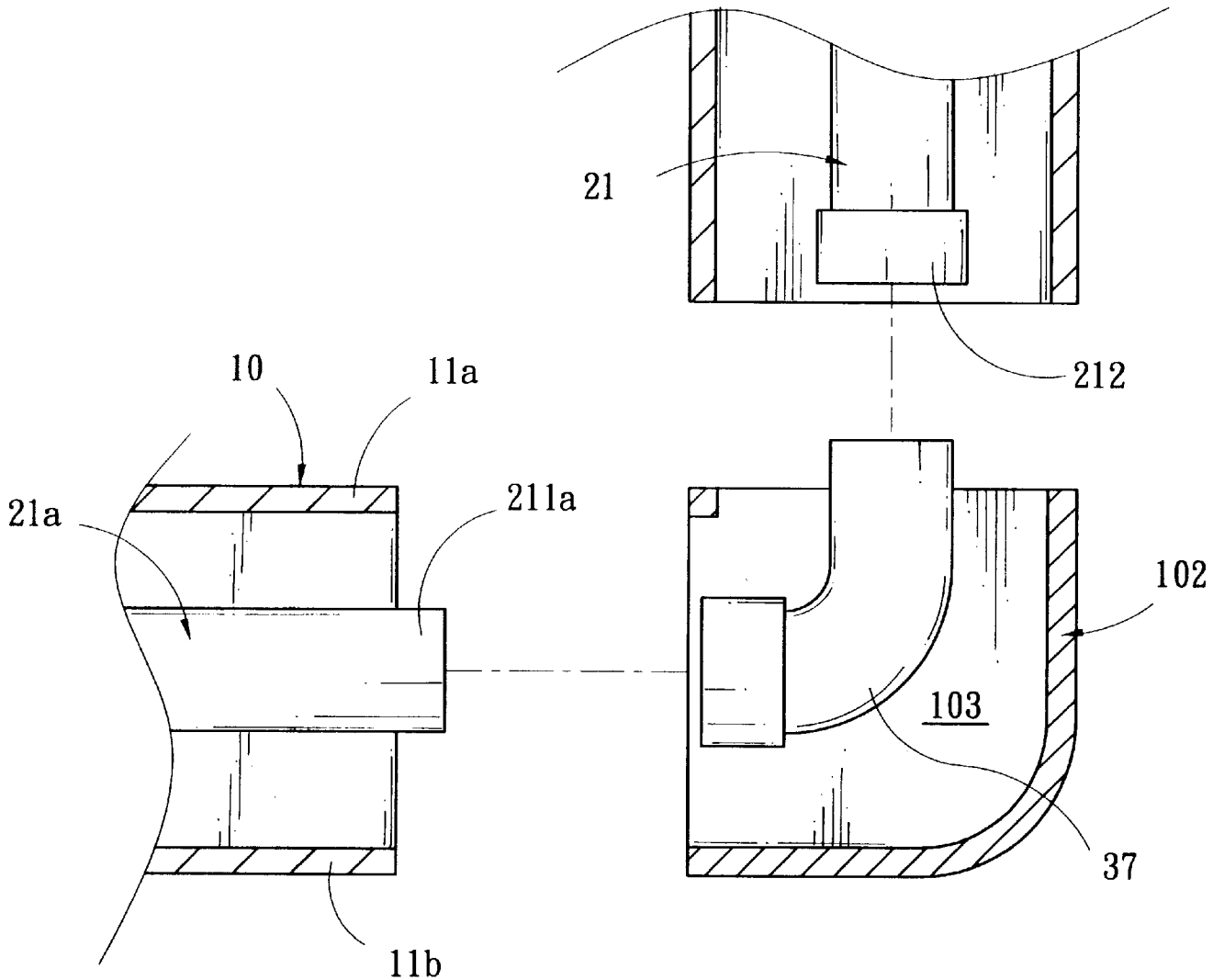
FIG. 17 is a partial view of an air-conditioning module of the invention, showing a comer connector built in a comer column for connecting and sealing ducts with an angle.

The connection of supplying ducts 20, returning ducts 21, and condensed water drains 32 of two partition panels can be fulfilled in different ways. For example, as shown in FIG. 16A, when two partition panels 10 link sequentially in a plane, a common duct 33 can be used to link them, e.g., two returning ducts 21 and 21*a*. On the other hand, as shown in FIG. 16B, when only one partition panel 10 is used, or at the end of the dust, a closed element 35 is used to seal the returning duct 21 (or the supplying duct 20 or drain 32, which are not shown). For the convenience of the installation, a removable cover 36, as shown in FIG. 15, is installed in a suitable position on the vertical panel 11*a* or 11*b*, so that a worker can easily install the common duct 33 or the closed element 35. As shown in FIG. 17, when two partition panels 10 link at an angle, e.g., in a corner, a corner column 102 and a bended connector 37 located in the corner column can be used to connect the two supplying ducts 20, returning ducts 21 and drains 32. At the bottom of the corner column 102, a passage 103 is designed to connect the two outside air supplying ducts 19 of the partition panels 10.

Figure 18:
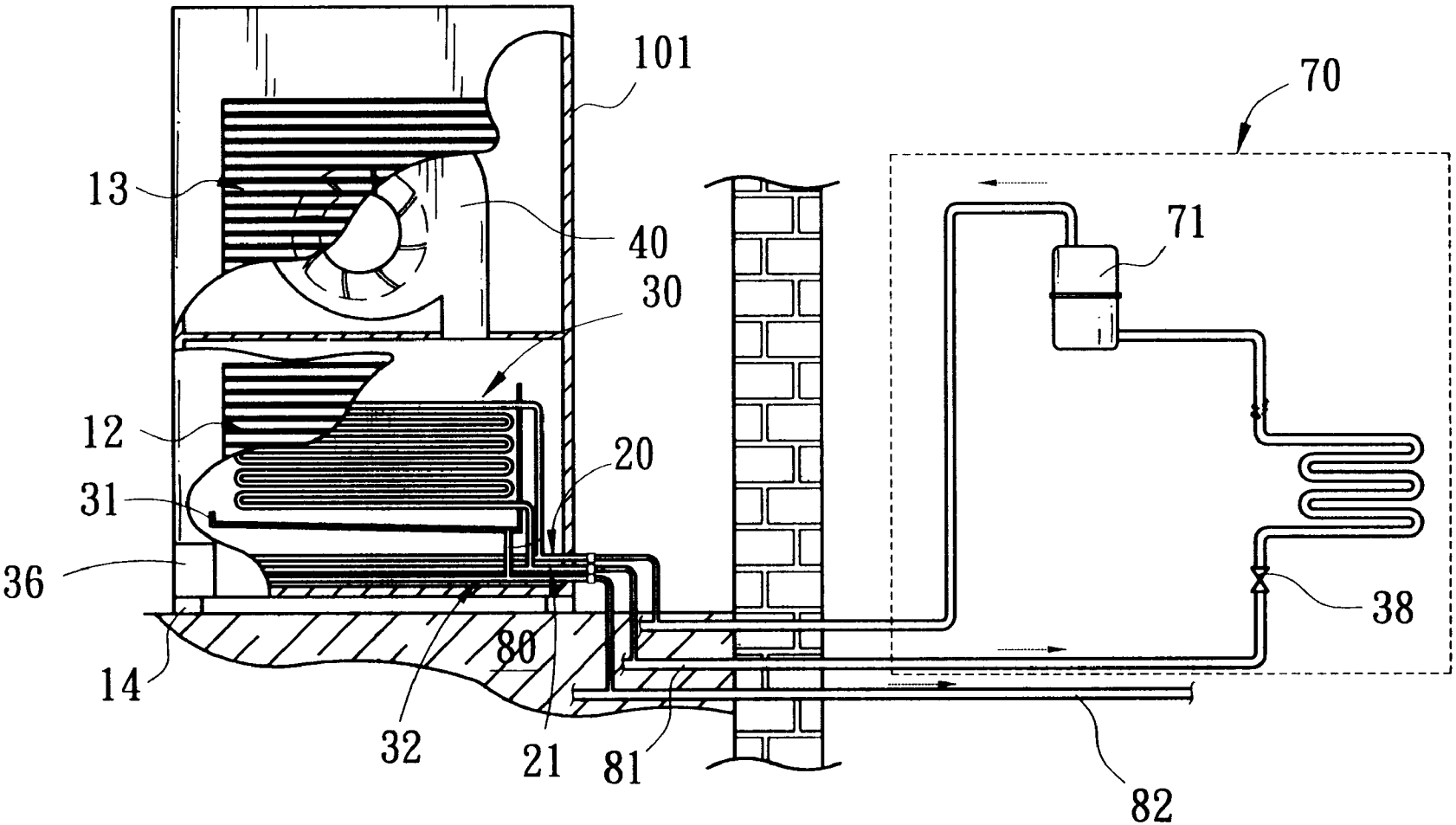
FIG. 18 is a sectional view of an air-conditioning module of the invention connecting with a refrigerant supply system.
Figure 19:
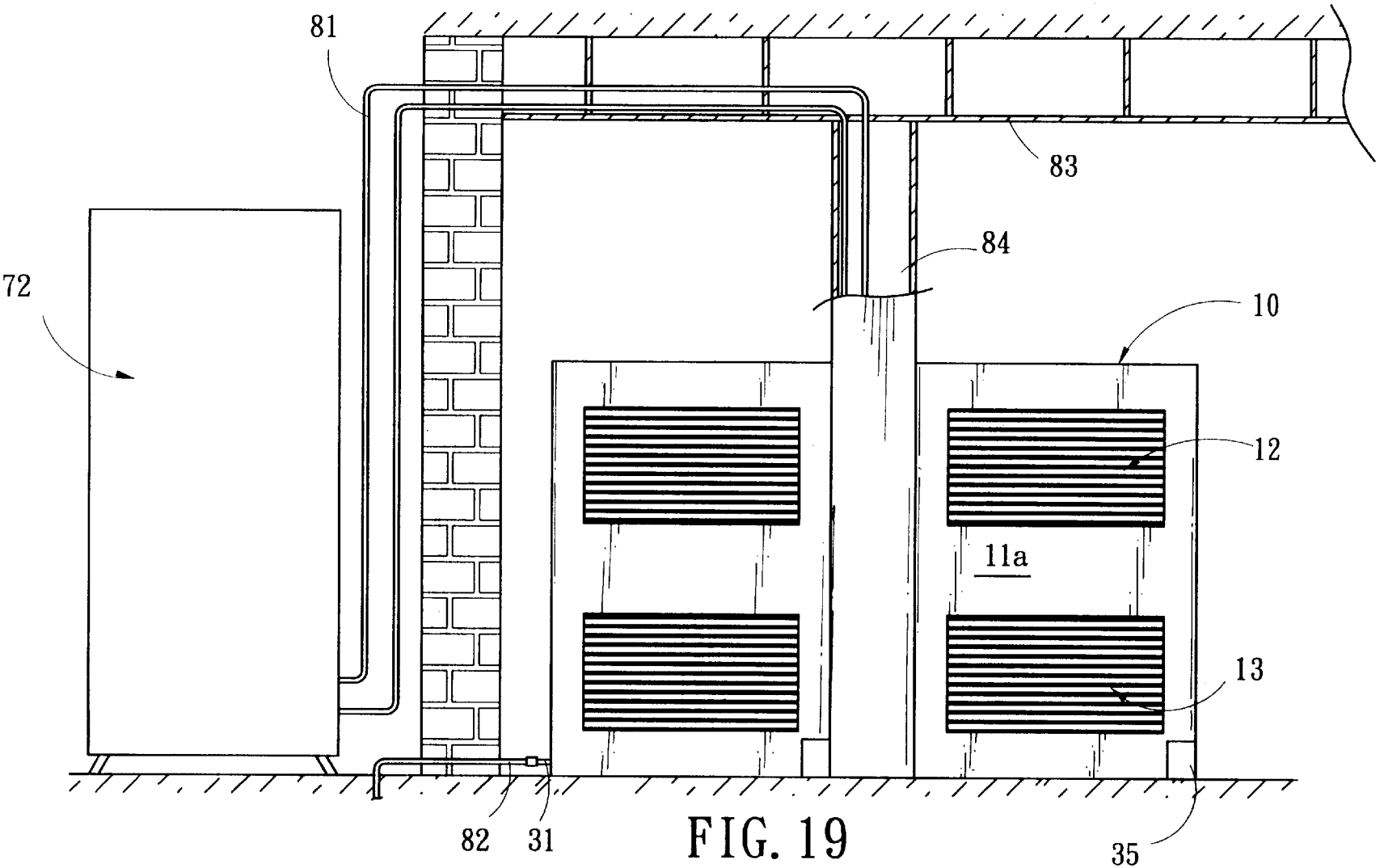
FIG. 19 is a sectional view of an air-conditioning module of the invention connecting with an chilled water supply system.
Figure 20:
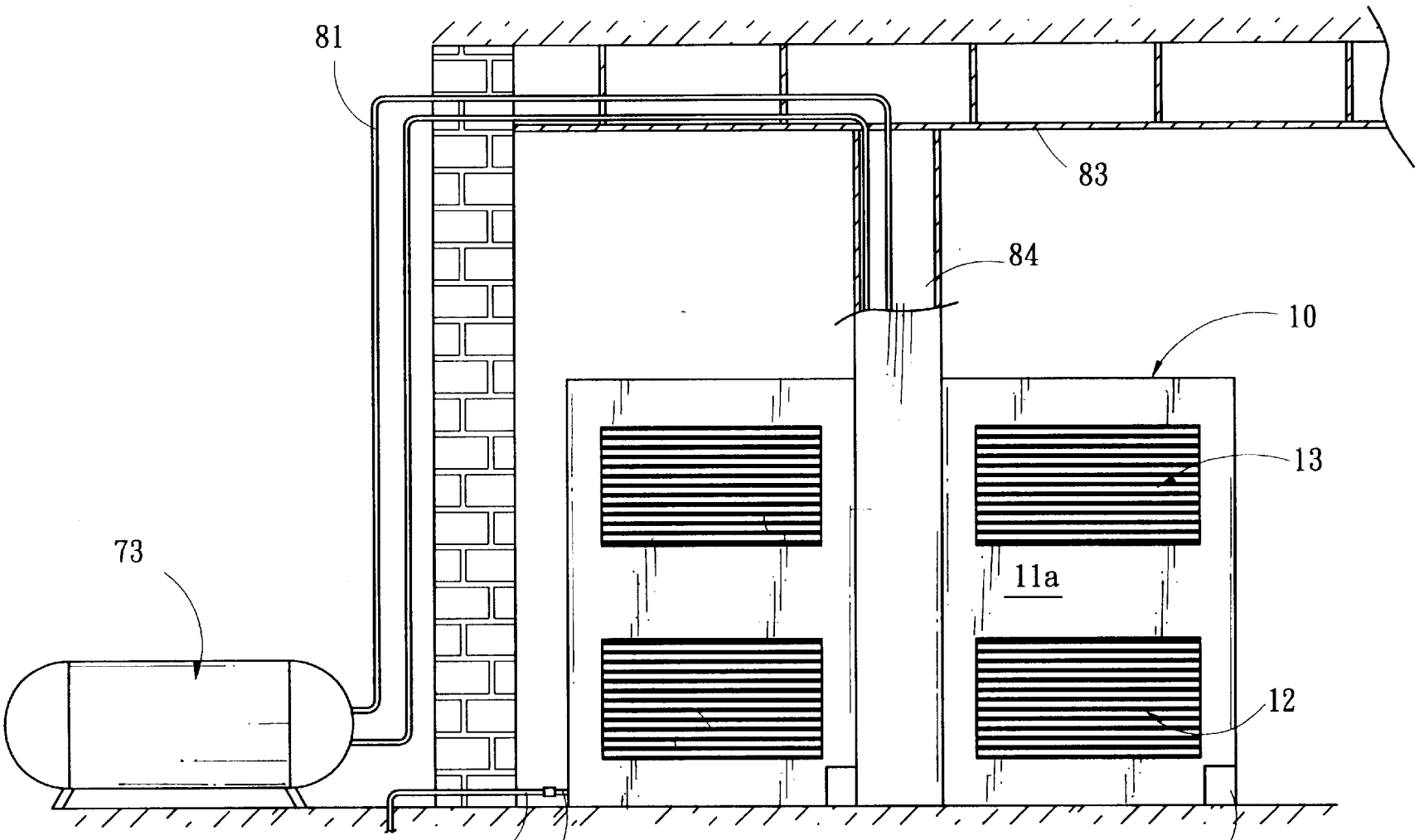
FIG. 20 is a sectional view of an air-conditioning module of the invention connecting with a hot water supply system.

Since the partition panel of the invention does not include a built-in heat transfer medium supply system, the heat transfer medium has to be delivered from a separate source. The embodiments of the heat transfer medium supply system will be described below.

a) Using a refrigerant supply system 70: when it is required to provide the function of cold air and dehumidification, the heat exchanger 30 of the air conditioning module of the invention serves as an evaporator for the refrigerant supply system 70. As shown in FIG. 13A, the refrigerant is compressed by a compressor 71 into hightemperature refrigerant vapor, then it discharges its heat at a condenser, to become liquid refrigerant and passes through piping 81 to the partition panel 10. After that, the liquid refrigerant passesthrough the supplying duct 20 and the expansion valve or capillary 38 to the heat exchanger 30, the liquid refrigerant absorbs heat and evaporates at the heat exchanger 30, so as to cool down the air passing through the surface of the heat exchanger 30. The evaporated refrigerant then returns to the refrigerant sypply system 70 via the returning duct 21 and the piping 81.The water condensed on the surface of the heat exchanger 30 can drop into a reservoir 31 and discharges from the drain 32 to the drainpipes 82 of the building. On the other hand, when the heating function is required, the heat exchanger 30 of the air conditioning module of the invention serves as a condenser of the refrigerant supply system 70, as shown in FIG. 18. The compressed refrigerant discharges its heat at the heat exchanger 30, so as to heat up the airflow passing through the surface of the heat exchanger 30. The heated air then comes out from the air outlet 12.

b) Using achilled water system 72: as shown in FIG. 19, the chilled water system 72 provides the chilled water which flows through the heat exchanger 30,so that the cold air can come out from the supply air outlet 12.

c) Using a hot water system 73: as shown in FIG. 20, the hot water system 73 provides the chilled water which flows through the heat exchanger 30, so that the warm air can come out from the supply air outlet 12.

In general, the aforesaid heat transfer medium supply system are located outside, the buildings, they can deliver the heat transfer medium to each partition panel through the piping 81 installed under the floor 80, as shown in FIG. 18. According to the location of the partition panel, the piping 81 is arranged in order to meet the requirements of each partition panel 10. Furthermore, the pipings can from a supply network.

In addition, the piping 81 can also be located in the ceiling 83, as shown in FIGS. 19 and 20. The piping 81 is extended in the ceiling to the preset positions, and is connected to each partition panel 10 via conduits in the wall or dummy hollow columns 84.

Figures 21A, 21B, 21C:
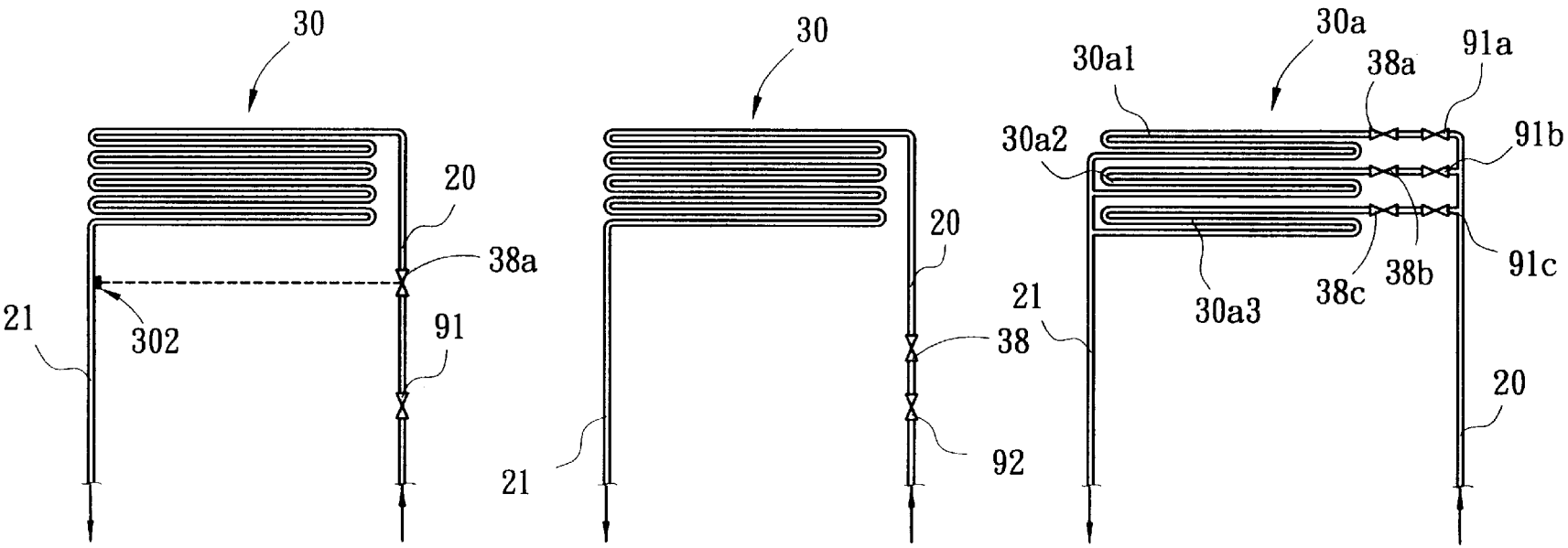
FIGS. 21A through 21C are flow control methods for refrigerant, applied to an air-conditioning module of the invention.
Figure 23:
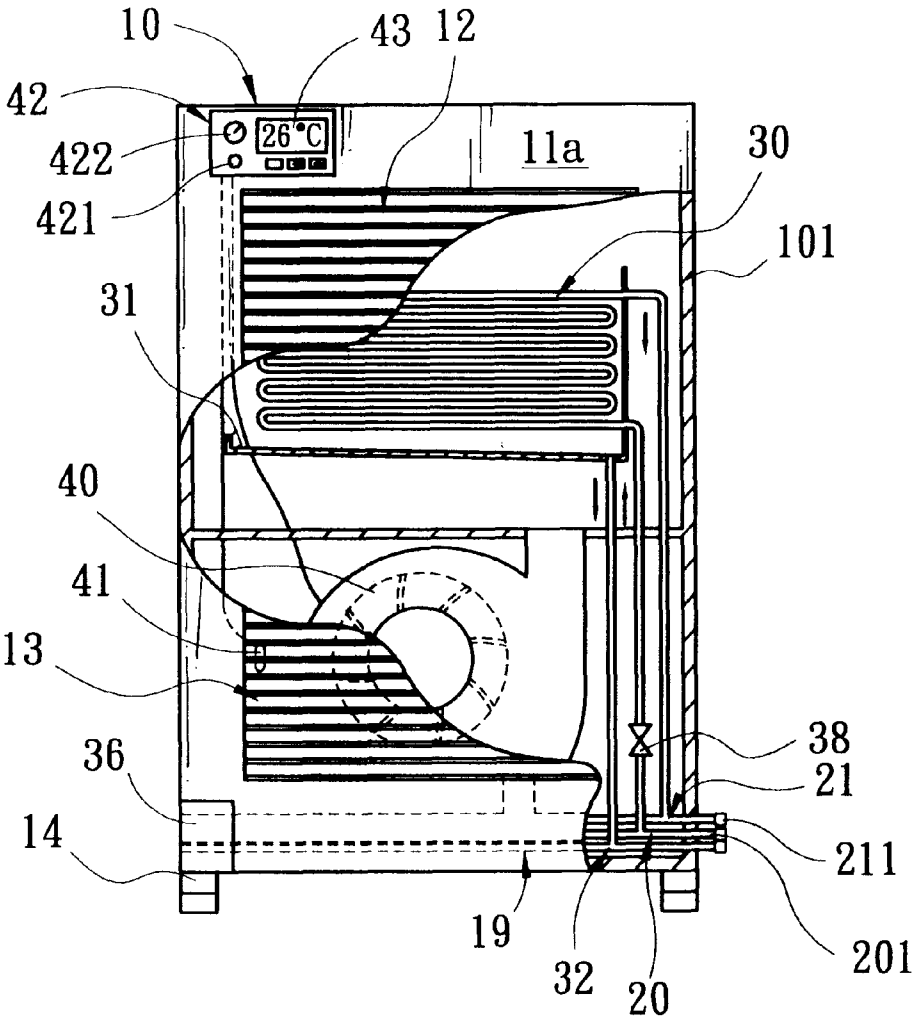
FIG. 23 is a sectional view showing a controller for adjusting the temperature of discharged air of an air-conditioning module of the invention.

The heat exchanger 30 can be designed with different capacities to meet different requirements of air conditioning. The supply air temperature is controlled by using a temperature sensor 41 and a controller 42, as shown in FIG. 23. By regulating the speed of the blower 40, the flow rate of the heat transfer medium or the speed of the compressor 71, (for example: the inverter-type compress)the supply air temperature can be controlled. To take a refrigeration system with a compressor 71 as an example, the flow rate of refrigerant can be controlled in one of the following ways.

a) As shown in FIG. 21A, a thermostat expansion valve 38*a* is fixed on the supplying duct 20 for controlling the flow rate of the refrigerant. The expansion valve 38*a* is controlled by the temperature at the outlet 302 of the heat exchanger 30. An on/off valve 91, such as solenoid valve, is installed before the expansion valve 38*a* to control the flow of the refrigerant.

b) As shown in FIG. 21B, a throttle valve 92 is connected between the supplying duct 20 and the heat exchanger 30,in order to control the flow rate of refrigerant passing through a capillary or an expansion device 38 to the heat exchanger 30.

c) As shown in FIG. 21C, the refrigerant in the supplying duct 20 is selectively provided to a plurality of branch tubes 30*a*1, 30*a*2, 30*a*3, each branch tube is respectively the necessary equipped with expansion devices 38*a*, 38*b*, 38*c* and an on/off valves 91*a*, 91*b*, 91*c* at the inlet, in order to control the flow rate of the refrigerant flowing into the branch tubes 30*a*1, 30*a*2, 30*a*3.

Figures 22A, 22B, 22C:
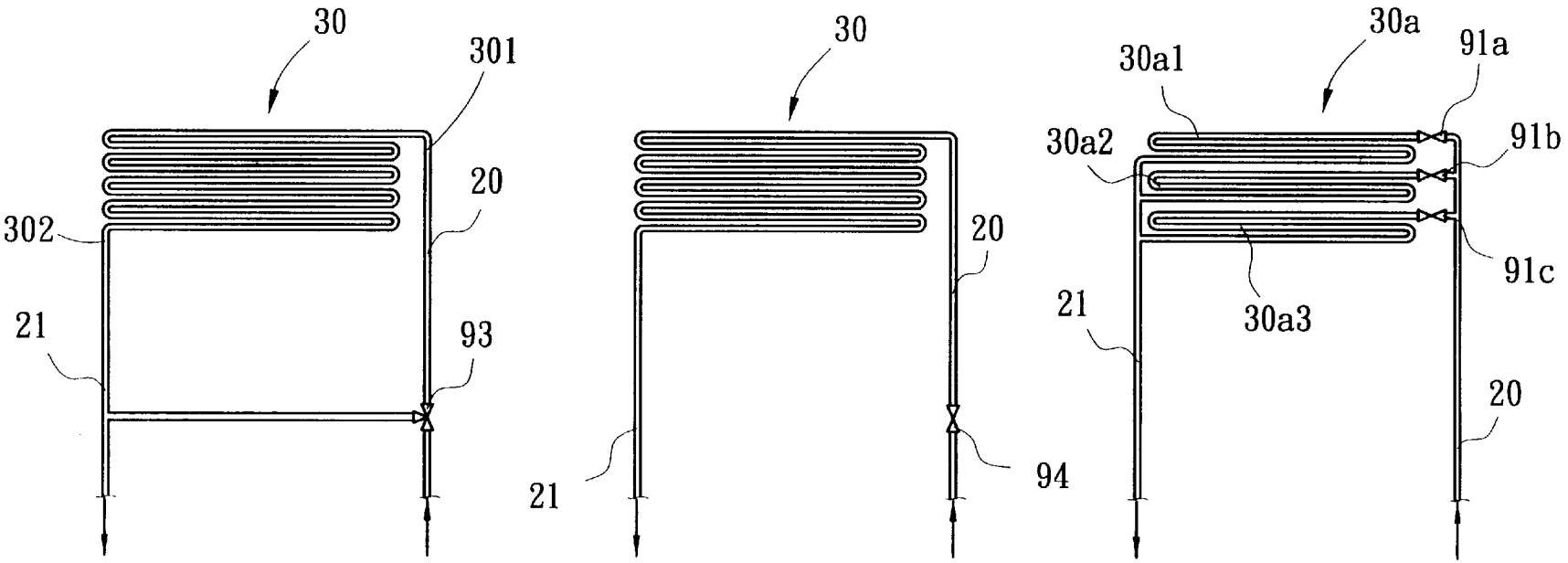
FIGS. 22A through 22C are flow control methods for icy or hot water, applied to an air-conditioning module of the invention.

FIGS. 22A, 22B and 22C are examples for the air conditioning modules using hot water or chilled water as heattransfer mediums. In these examples, the temperature of the supply air is completely controlled by the flow rate of the heat transfer medium in the heat exchanger 30.

In FIG. 22A, a three-way valve 93 is used to control the flow rate of heat transfer medium in the heat exchanger 30. The three ports of the three-way valve 93 respectively connect with the supplying duct 20, the returning duct 21 and the inlet 301 of the heat exchanger 30. If the heat transfer medium is partially guided into the returning duct 21, the flow rate of the heat transfer medium is decreased in the heat exchanger 30 Otherwise, the flow rate of the heat transfer medium is increased in the heat exchanger 30.

In FIG. 22B, a two-way valve 94 is used to control the flow rate of the transfer medium in the heat exchanger 30.

In FIG. 22C, the heat transfer medium in the supplying duct 20 is selectively provided to a plurality of branch tubes 30*a*1, 30*a*2, 30*a*3 each branch tube is respectively equipped with the on/off valves 91*a*, 91*b*, 91*c* at the inlet, in order to control the flow rate of the heat transfermedium in the branch tubes 30*a*1, 30*a*2, 30*a*3.

The temperature of the supply air can also be controlled by adjusting the airflow rate at the air outlet 12, such as by adjusting the flow rate of the blower 40 or by adjusting the area of the air outlet 12. In a preferable embodiment of the invention, as shown in FIG. 23, a controller 42 is mounted on the vertical panel 11*a* of the partition panel 10. The controller 42 includes at least: a start button 421 for turning on the air conditioning module; a flow rate control button 422 for adjusting the flow rate of the blower 40; and a temperature control circuit unshown in FIG. 23 for adjusting the temperature of supply air by controlling the speed of the blower 40, the speed of the compressor 71, or the flow rate of the heat transfer medium, as shown in FIGS. 21A to 21C, and FIGS. 22A to 22C.

Of course, if an ozone cleaning apparatus 18 or an automatic guide vane 15 is incorporated, the relative control buttons have to be included in the controller 42. A temperature display 43 can also be incorporated for providing better operation.

Figure 24:
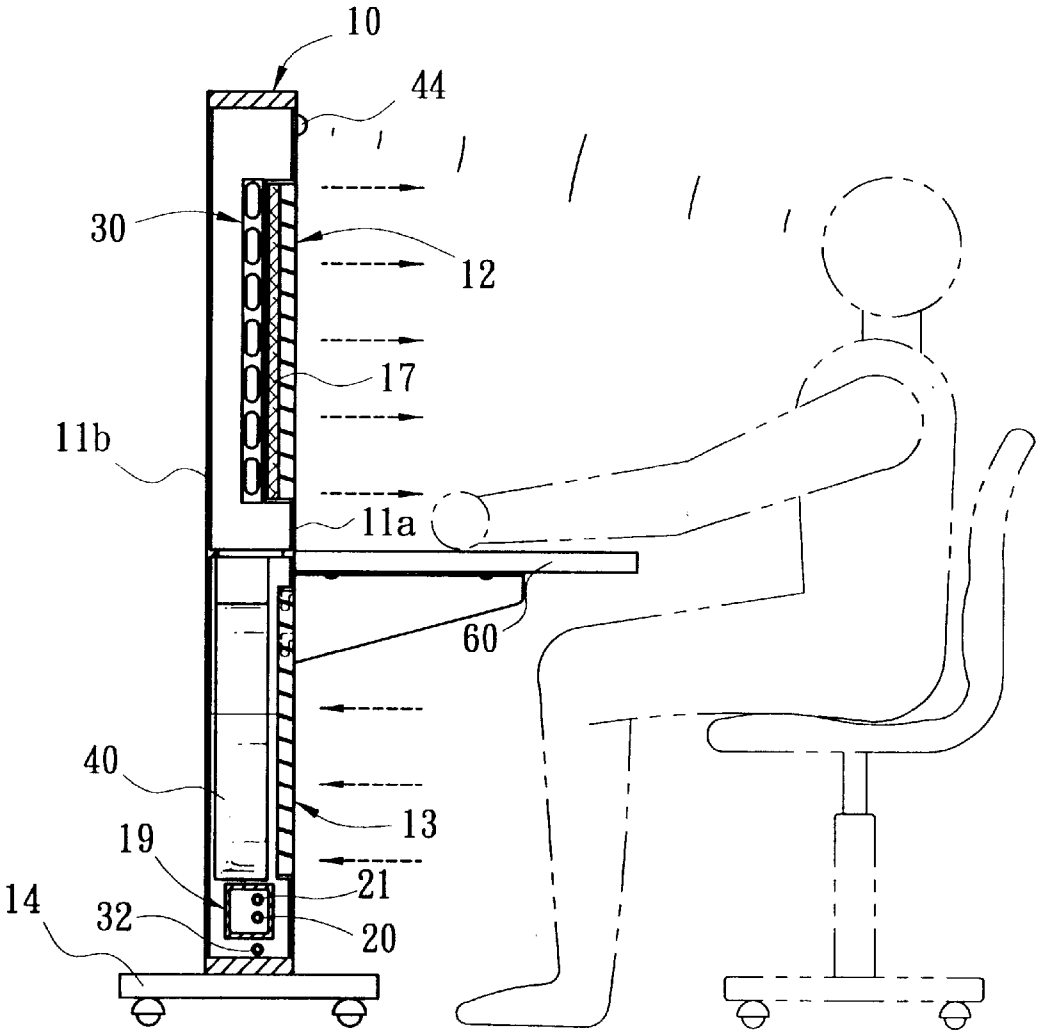
FIG. 24 is a further embodiment of an air-conditioning module built in a partition panel according to the invention, showing a human detector incorporated.

In FIG. 24, a partition panel 10 with an air conditioning module according to the invention further includes a human occupied sensor 44, in order to detect the working space covered by the supply air whether it is occupied by a person. If there is a person, the air conditioning function is turned on, and it is shut off when the person leaves. The human occupied sensor 44 automatically controls the air conditioning function based on the appropriate responses in order to save the energy and the costs.

In conclusion, a partition panel with air conditioning module according to the invention has at least the following advantages.

a) It is a modular unit suitable for the assembly of personal working compartments. The air conditioning module in the partition panel can accommodate individual requirements.

b) The air conditioning module is designed only for the personal working space. No extra heat load from the ceiling or the wall need to cover, so it saves energy.

c) Fresh supply air can be provided by equipped for the air conditioning module, so that the person in the working space can enjoy the best quality air.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air conditioning module applicable to a partition panel, comprising:

a partition panel, having a hollow formed with a side frame and two opposite vertical panels; said partition comprises a supply air outlet and a return air inlet, and an air passage formed in the hollow and linking between said supply air outlet and said return air inlet;

a heat transfer medium supply system for supplying a heat transfer medium to said air conditioning module, the heat transfer medium supply system including a refrigerant compressor, a condenser and an expansion device;

a supplying duct for directing said heat transfer medium from said supply system to said air conditioning module; said supplying duct having one end for sharing said heat transfer medium to another similar partition panel linking adjacent to said partition panel;

a returning duct, for returning said heat transfer medium from said air conditioning module to said supply system after the function of heat exchange; said returning duct having one end for also returning the heat transfer medium from said another similar partition panel linking adjacent to said partition panel;

a heat exchanger, locating in said partition panel at said air passage between said return air inlet and said supply air outlet, linking between said supplying duct and said returning duct for utilizing said heat transfer medium passing through said heat exchanger to make heat exchange with the air passing through said air passage, the heat exchanger being connected to the supplying duct via the expansion device and serving as an evaporator for cooling down the air passing through the air passage;

a blower, locating in said partition panel, for propelling the air coming from said return air inlet to pass through said air passage for the function with said heat exchanger and releasing from said supply air outlet;

a temperature sensor for detecting air temperature at said returning air inlet; and a controller for controlling the temperature of air released from said supply air outlet according to said temperature detection of said temperature sensor.

2. An air conditioning module applicable to a partition panel according to claim 1 further comprises a water reservoir locating under said heat exchanger for collecting condensed water, and a drain connecting to said water reservoir for draining water out of said partition panel.

3. An air conditioning module applicable to a partition panel according to claim 1 wherein said heat transfer medium supply system is a chilled water system.

4. An air conditioning module applicable to a partition panel according to claim 3 further comprises a water reservoir locating under said heat exchanger for collecting condensed water, and a drain connecting to said water reservoir for draining water out of said partition panel.

5. An air conditioning module applicable to a partition panel according to claim 3 further comprises:

a temperature sensor for detecting air temperature at said return air inlet; and a controller for controlling the temperature of air released from said supply air outlet according to said temperature detection of said temperature sensor.

6. An air conditioning module applicable to a partition panel according to claim 5 wherein said controller controls air temperature by modulating the speed of said blower.

7. An air conditioning module applicable to a partition panel according to claim 5 wherein said controller controls air temperature by modulating the flow rate of heat transfer medium passing through said heat exchanger with a two-way valve locating at inlet of said heat exchanger.

8. An air conditioning module applicable to a partition panel according to claim 5 wherein said controller controls air temperature by modulating the flow rate of heat transfer medium passing through said heat exchanger with a three-way valve locating at inlet of said heat exchanger.

9. An air conditioning module applicable to a partition panel according to claim 1 further comprises the guide vanes locating at said supply air outlet and said returning air inlet.

10. An air conditioning module applicable to a partition panel according to claim 1 further comprises an air filter locating in said air passage.

11. An air conditioning module applicable to a partition panel according to claim 1 further comprises an air cleaner locating in said air passage.

12. An air conditioning module applicable to a partition panel according to claim 1 wherein said heat transfer medium supply system comprises a refrigerant compressor, an evaporator and an expansion device; said heat exchanger serves as a condenser for heating up the air passing through said air passage.

13. An air conditioning module applicable to a partition panel according to claim 1 wherein said heat transfer medium supply system is a hot water system.

14. An air conditioning module applicable to a partition panel according to claim 1 wherein said controller controls air temperature by modulating the speed of said blower.

15. An air conditioning module applicable to a partition panel according to claim 1 wherein said controller controls air temperature by modulating the flow rate of refrigerant passing through said heat exchanger with an expansion device locating at inlet of said heat exchanger.

16. An air conditioning module applicable to a partition panel according to claim 1 wherein said controller controls air temperature by modulating the flow rate of refrigerant passing through said heat exchanger with a thermostat expansion valve locating at inlet of said heat exchanger and detecting temperature at outlet of said heat exchanger.

17. An air conditioning module applicable to a partition panel according to claim 1 wherein said controller controls air temperature by modulating the flow rate of refrigerant passing through said heat exchanger with changing the speed of said compressor.

18. An air conditioning module applicable to a partition panel according to claim 1 further comprises:

an outside air supplying duct locating in said partition panel;

supplying duct, prepared in a building for delivering outside air to said outside air supplying duct; and a blower and air filter, locating outside for providing fresh air to said supplying duct.

* * * * *